US007204438B2

(12) United States Patent
Hisamitsu

(10) Patent No.: US 7,204,438 B2
(45) Date of Patent: Apr. 17, 2007

(54) IMPACT CRUSHING APPARATUS FOR GRAIN

(75) Inventor: Yasushi Hisamitsu, Tokyo (JP)

(73) Assignee: Satake Corporation, Tokyo (JP)

( * ) Notice: Subject to any disclaimer, the term of this patent is extended or adjusted under 35 U.S.C. 154(b) by 0 days.

(21) Appl. No.: 10/832,360

(22) Filed: Apr. 27, 2004

(65) Prior Publication Data

US 2004/0227023 A1 Nov. 18, 2004

(30) Foreign Application Priority Data

May 13, 2003 (JP) ..... 2003-134295

(51) Int. Cl.
*B02C 19/00* (2006.01)

(52) U.S. Cl. ..... 241/74; 241/86.1; 241/275

(58) Field of Classification Search ..... 241/86.1, 241/275, 74

See application file for complete search history.

(56) References Cited

U.S. PATENT DOCUMENTS 3,334,823 A * 8/1967 Behnke et al. ..... 241/275
3,381,904 A 5/1968 Glidden
5,058,815 A * 10/1991 Pozzato et al. ..... 241/192
5,201,469 A * 4/1993 Urschel ..... 241/5

FOREIGN PATENT DOCUMENTS

| | | |
|---|---|---|
| DE | 1189 360 | 3/1965 |
| JP | 63-305945 | 12/1988 |
| JP | 6-296888 | 10/1994 |
| WO | 91/11260 | 8/1991 |

* cited by examiner

*Primary Examiner*—Mark Rosenbaum
(74) *Attorney, Agent, or Firm*—Staas & Halsey LLP

(57) ABSTRACT

The present invention relates to an impact crushing apparatus that mills grain between a milling cylinder and a screen. Each of a plurality of blades mounted along the circumference of the milling cylinder comprises a columnar body with a square cross section, cutting tools disposed on all ridges of the columnar body, and mounting parts formed at the top and bottom of the columnar body. Each blade is attached to the milling cylinder in such a way that any one of the four directions of the blade can be selected by rotating the blade around the central axis of the columnar body.

5 Claims, 8 Drawing Sheets

IMPACT CRUSHING APPARATUS FOR GRAIN

BACKGROUND OF THE INVENTION

1. Field of the Invention

The present invention relates to an impact crushing apparatus that mills granular materials, more particularly grain, by impact.

2. Description of the Related Art

A conventional example of a crushing apparatus that mills grain by impact (hereinafter referred to as impact crushing apparatus) is disclosed in International Publication WO 91/11260. Grain is supplied from a supply pipe of the apparatus to a centrifugal wheel, from the outer edge of which the grain strikes against an impact ring due to centrifugal force caused by rotation. The milled grain is ejected from an outlet path. The centrifugal wheel comprises a pair of coaxial rotational disks spaced vertically, one being an inner disk and the other an outer disk, and a plurality of pins, equally spaced in a circumference, connecting the outer edge of the outer rotational disk and the outer edge of the inner rotational disk. These pins disperse blocks of grain moving in the centrifugal direction and evenly direct the grain toward the impact ring. The grain is milled by striking against the impact ring rather than by the pins.

Another conventional example of an impact crushing apparatus is disclosed in Japanese Patent Application Laid-open No. 63-305945. The apparatus is a sample crushing apparatus included in a measuring instrument that analyzes and measures constituents of rice and the like. Granular grain supplied from an opening of the apparatus is impelled toward a perforated ring by centrifugal force caused by rotation of a milling disk, and is beaten and milled between the perforated ring and a plurality of high-speed rotating vanes disposed at the outer edge of the milling disk. The milled grain that has passed through the holes in the perforated ring also passes through a powder collecting path and then is retrieved. The grain is milled repeatedly between the perforated ring and the plurality of high-speed rotating vanes, so it is important to maintain an appropriate clearance between the tip of each vane and the perforated ring for efficient milling. Since these vanes suffer from wear, they must be replaced after being used for a fixed length of time. When the vanes are replaced, however, all vanes must be discarded and new ones must be installed; alternatively, the entire milling disk must be replaced. This is costly and wasteful.

A further conventional example of an impact crushing apparatus is disclosed in Japanese Patent Application Laid-open No. 06-296888. The apparatus crushes pieces of wood by mounting a rotational shaft horizontally in a crushing box and swingably attaching crushing blades to the rotational shaft through supporting plates and supporting shafts. The wood is crushed by the impact of the crushing blades. The crushing blades can be replaced when they wear out. A single crushing blade has a rectangular shape with blade parts at the four corners, prolonging the time during which the crushing blade can be used. However, crushing apparatus of this type cannot be used for milling grain without alteration of its structure.

SUMMARY OF THE INVENTION

An object of the present invention is to provide an impact crushing apparatus that mainly mills granular grain with an even granularity and has advantages of prolonging the life of the vanes (blades) used for milling, providing an adjustable milling clearance, and enabling replacement on a per-vane basis.

The impact crushing apparatus of the present invention comprises a supply opening from which raw material to be milled is supplied, a milling cylinder disposed below the supply opening and provided with a plurality of blades spaced on its outer edge, a screen cylinder fixed outside the outer edge of the milling cylinder, an outlet path disposed outside the screen cylinder for ejecting milled grain, and a driving section that rotates the milling cylinder. The milling cylinder has an upper ring and lower ring that are disposed concentrically with a predetermined spacing. Each blade includes a columnar main body with a polygonal cross section and cutting tools attached along all of a plurality of ridges of the columnar main body. The top and bottom of the blade are attached to the upper ring and lower ring, respectively; the blade can be rotated by predetermined angles around the central axis of the columnar main body so that any one of a plurality of attachment directions relative to the upper ring and lower ring can be selected.

The impact crushing apparatus of the present invention may take the following form.

The distance between the cutting edge of the cutting tool attached along one ridge of the columnar main body and the central axis of the columnar main body is different from the distance between the cutting edge of the cutting tool attached along another ridge and the central axis of the columnar main body.

The cross section of the columnar main body of the blade is approximately square. Therefore, the blade is selectively attachable to the upper ring and lower ring in one of four directions selected by rotating the columnar main body around its central axis.

A lower mounting part protrudes from the bottom of the columnar main body. A plurality of notches are formed along the outer edge of the upper ring of the milling cylinder, into each of which the columnar main body of a blade can fit externally. A plurality of mounting holes are also formed in the lower ring at the positions corresponding to the positions of the notches in the upper ring so that the lower mounting parts on the columnar main bodies can fit into the mounting holes.

An upper mounting part protrudes from the top of the columnar main body. When the lower mounting part of the columnar main body fits into a mounting hole in the lower ring and the columnar main body fits into a notch in the upper ring, the upper mounting part appears above the upper ring. If a fixing ring having a plurality of mounting holes formed along its circumference is placed on the upper ring, the upper mounting parts of the columnar main bodies fit into the mounting holes in the fixing ring.

The milling blades of the impact crushing apparatus of the present invention each have a plurality of cutting tools, usable in turn, thereby prolonging the life of the blades. This also eliminates the wasteful need to replace the entire milling cylinder when a single cutting tool is worn out. If the distance between the cutting tool and the screen cylinder can be adjusted when the cutting tool is changed, the waste of having to replace all blades or the entire milling cylinder in order to adjust the distance from the screen cylinder is eliminated. Furthermore, all blades can be taken out just by removing the fixing ring, facilitating adjustment and replacement of the cutting tools.

BRIEF DESCRIPTION OF THE DRAWINGS

The purposes and advantages of the present invention, including those described above, will be clarified by reference to the attached drawings in combination with the description of the embodiment presented below. Of these drawings.

DESCRIPTION OF THE EMBODIMENTS

Figure 1:
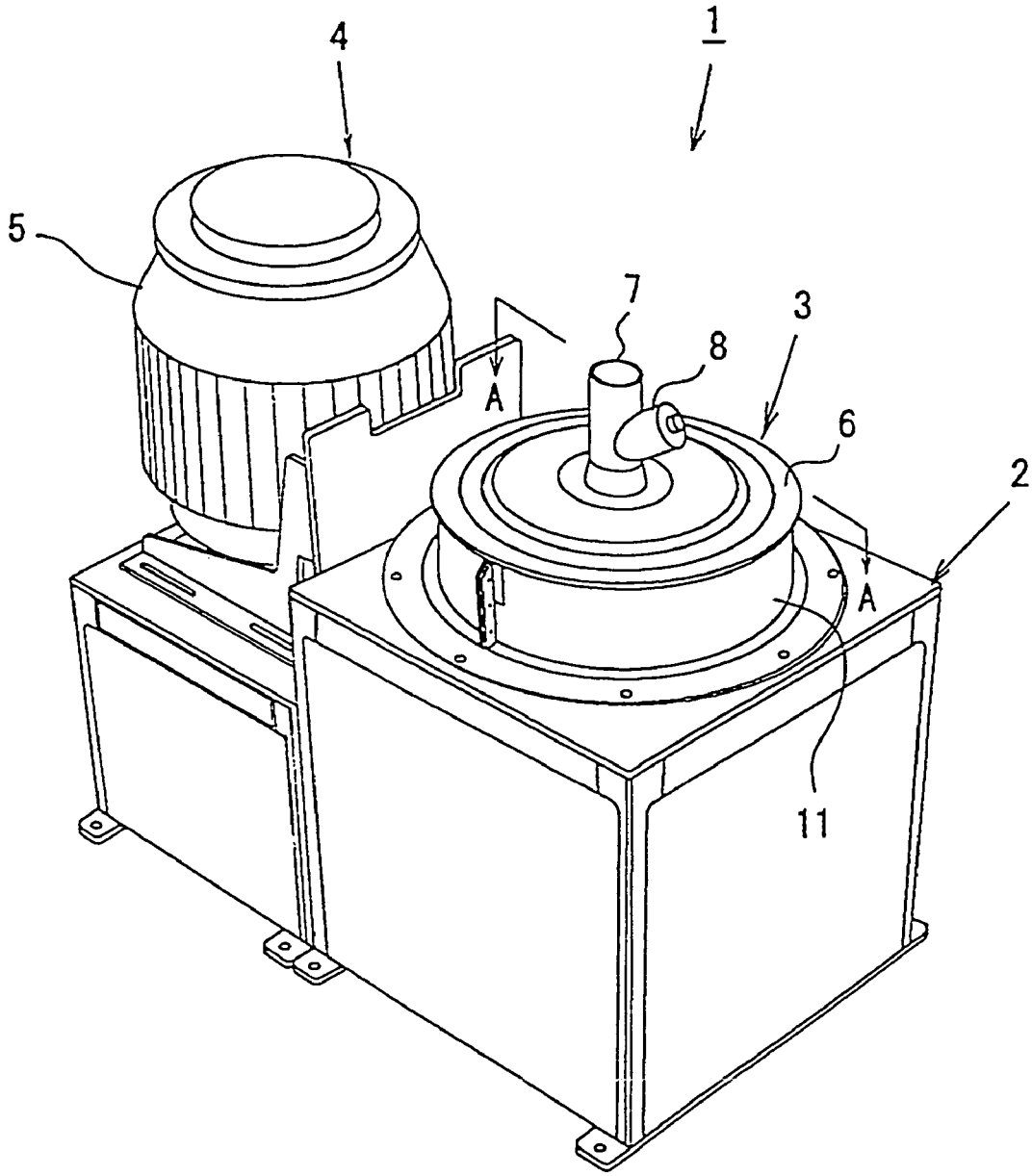
FIG. 1 is an overall perspective view of an impact crushing apparatus according to the present invention.

The impact crushing apparatus 1 comprises a cabinet 2, a milling section 3, and a driving section 4, as shown in FIG. 1. The driving section 4 includes a motor 5 as a power source. The milling section 3 is approximately cylindrical and sealed by a lid 6. The lid 6 is provided with a supply pipe 7. The top of the supply pipe 7 is connected to a hopper (not shown), and its bottom leads to the interior of the milling section 3. A vacuum pipe 8 communicates with the supply pipe 7 at the midpoint.

Figure 2:
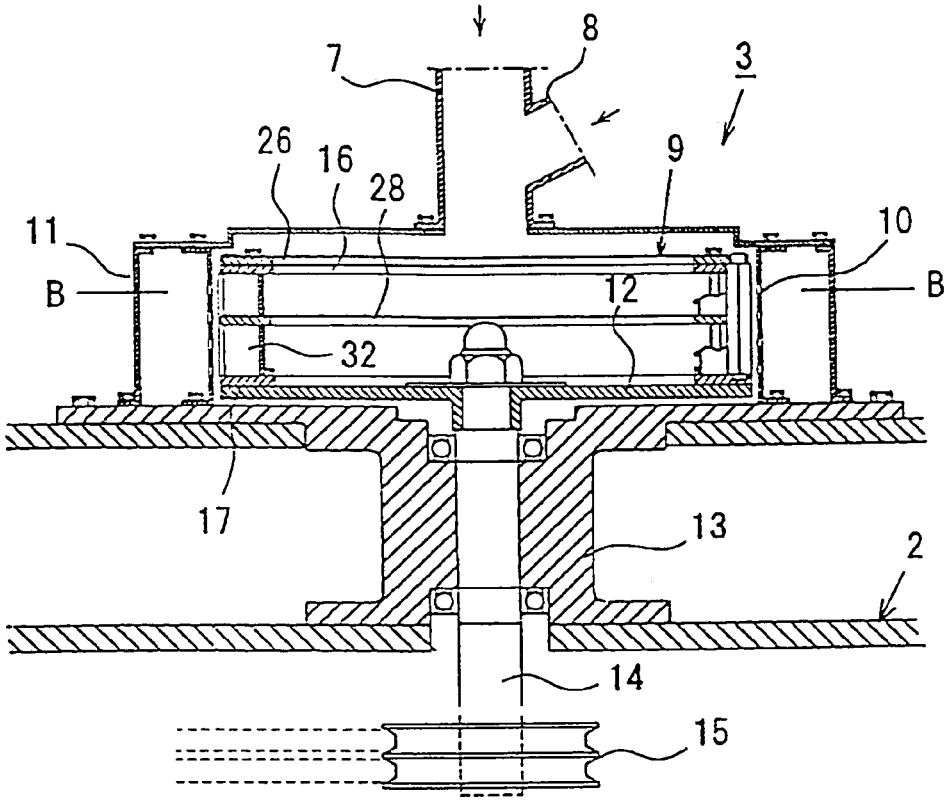
FIG. 2 is a sectional view showing section A—A in FIG. 1, illustrating a longitudinal section of the milling section.
Figure 4:
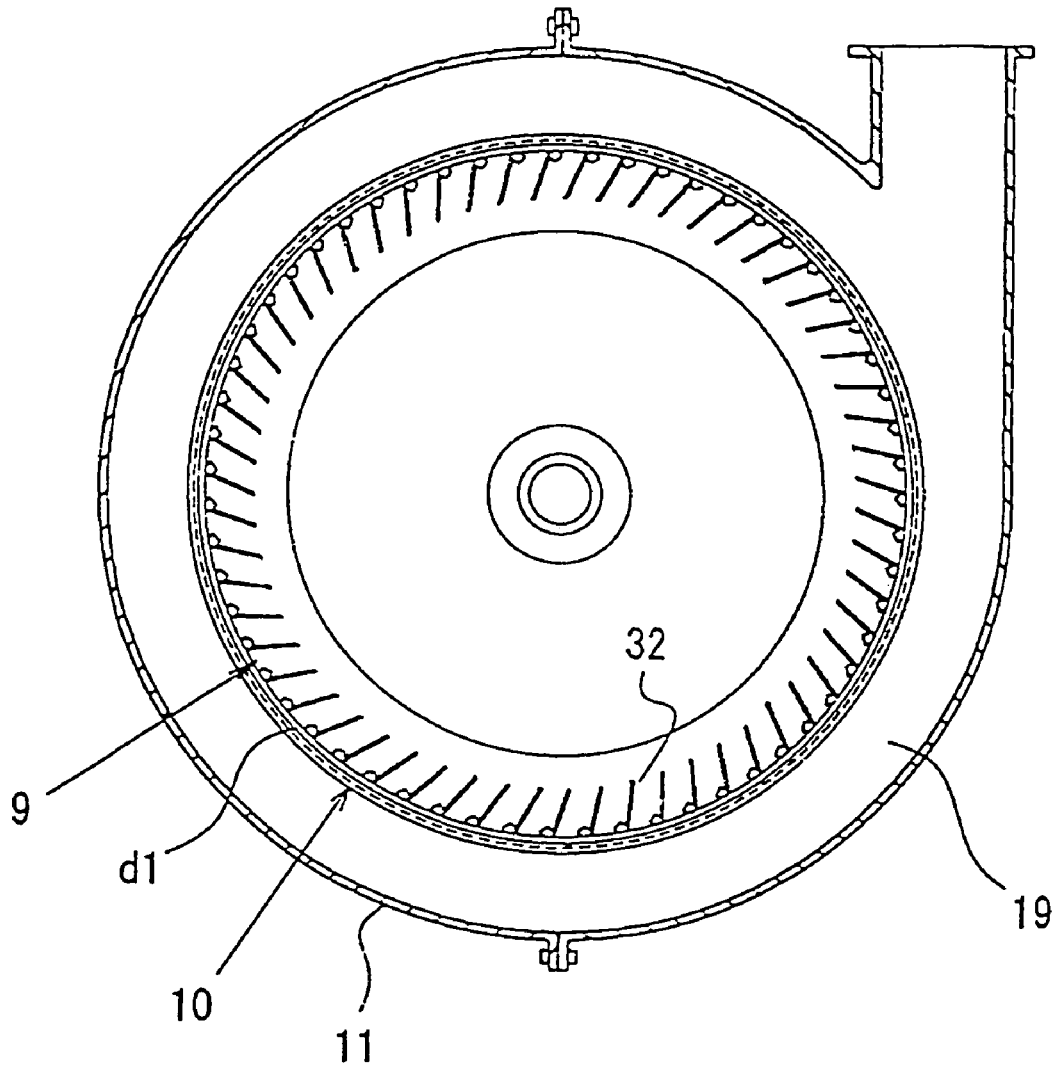
FIG. 4 is a sectional view showing section B—B in FIG. 2.

The milling section 3 internally includes a milling cylinder 9 and a screen cylinder. (hereinafter referred to as screen) 10, as shown in FIG. 2. The milling cylinder 9 and screen 10 are sealed by an outer cylinder 11 and the lid 6. The milling cylinder 9, screen 10, and outer cylinder 11 are disposed concentrically, as shown in FIG. 4. The outer cylinder 11 and screen 10 are secured on the top of the cabinet 2, as shown in FIG. 2. The milling cylinder 9 is secured on a rotational disk 12 that is secured atop a rotational shaft 14 pivoted on a bearing 13 in the cabinet 2. The rotational shaft 14 is rotated by a motor 5 (shown in FIG. 1) through a pulley 15 disposed at the bottom of the rotational shaft.

Figure 5:
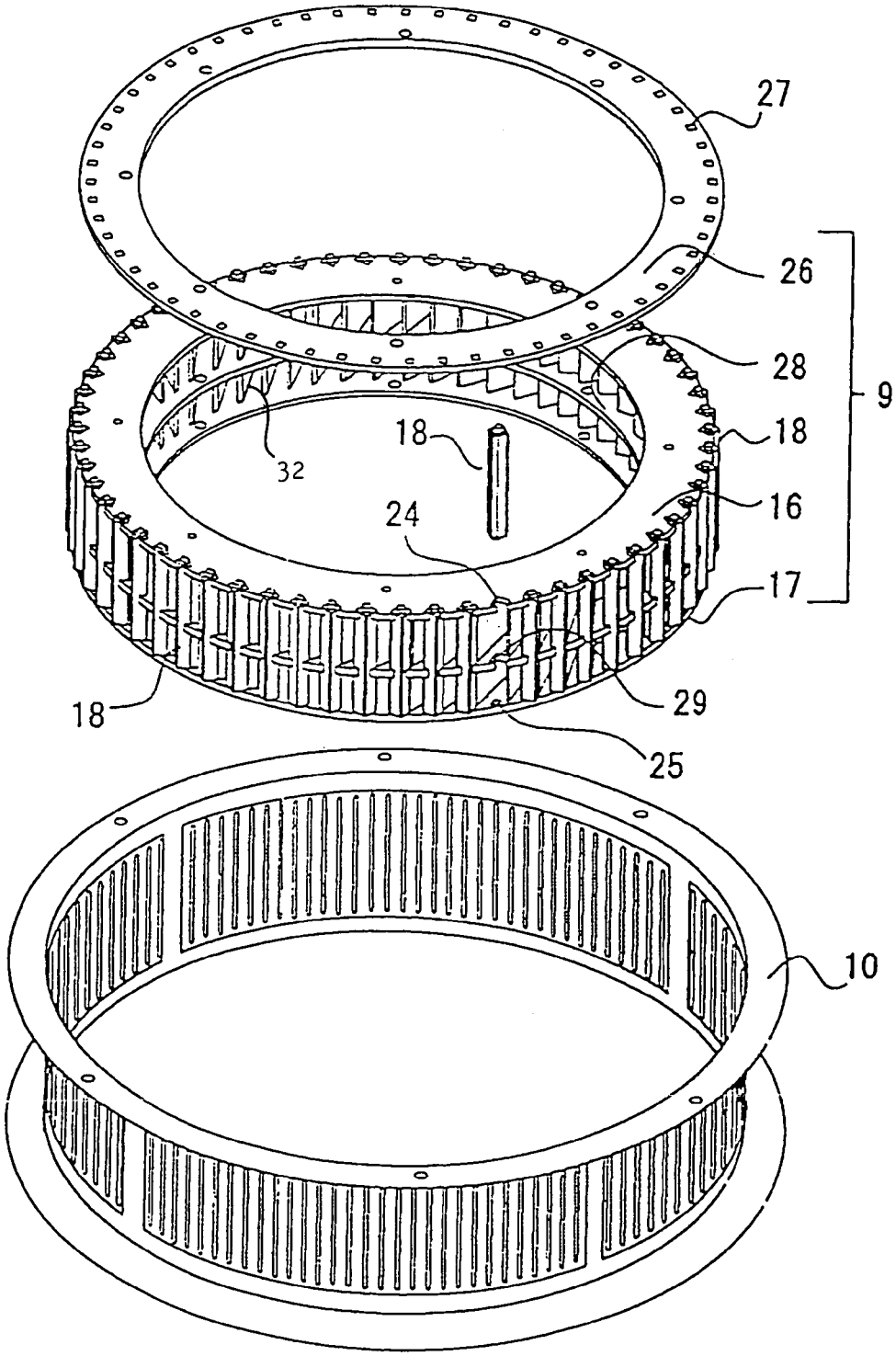
FIG. 5 is a perspective view of the milling cylinder and screen in the impact crushing apparatus in FIG. 1.

The milling cylinder 9 includes an upper ring 16 and lower ring 17 sharing a common central axis, as shown in FIG. 5, with a predetermined amount of vertical spacing between them. The outer edges of the upper ring 16 and lower ring 17 are interconnected by a plurality of blades 18 equally spaced in a circumference and parallel to the rotational shaft 14.

Figure 3:
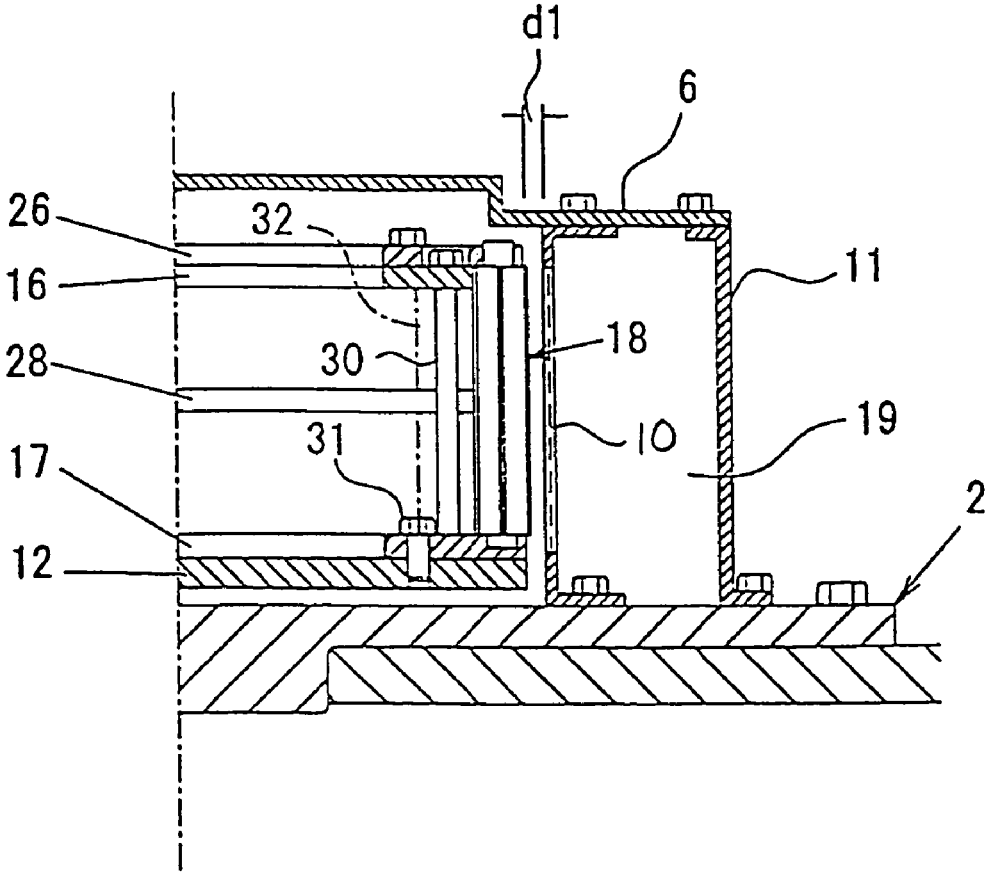
FIG. 3 is an enlarged view of part of FIG. 2.

The supply opening of the supply pipe 7 is positioned above and at the center of the rotational disk 12. As shown in FIG. 3, there is a milling clearance d1 between the milling cylinder 9 and screen 10. The milling clearance d1 is set according to the size and type of grain. For wheat, for example, the milling clearance d1 is approximately 1 to 2 mm. An outlet path 19 for ejecting the milled grain is provided between the screen 10 and outer cylinder 11.

Figure 6:
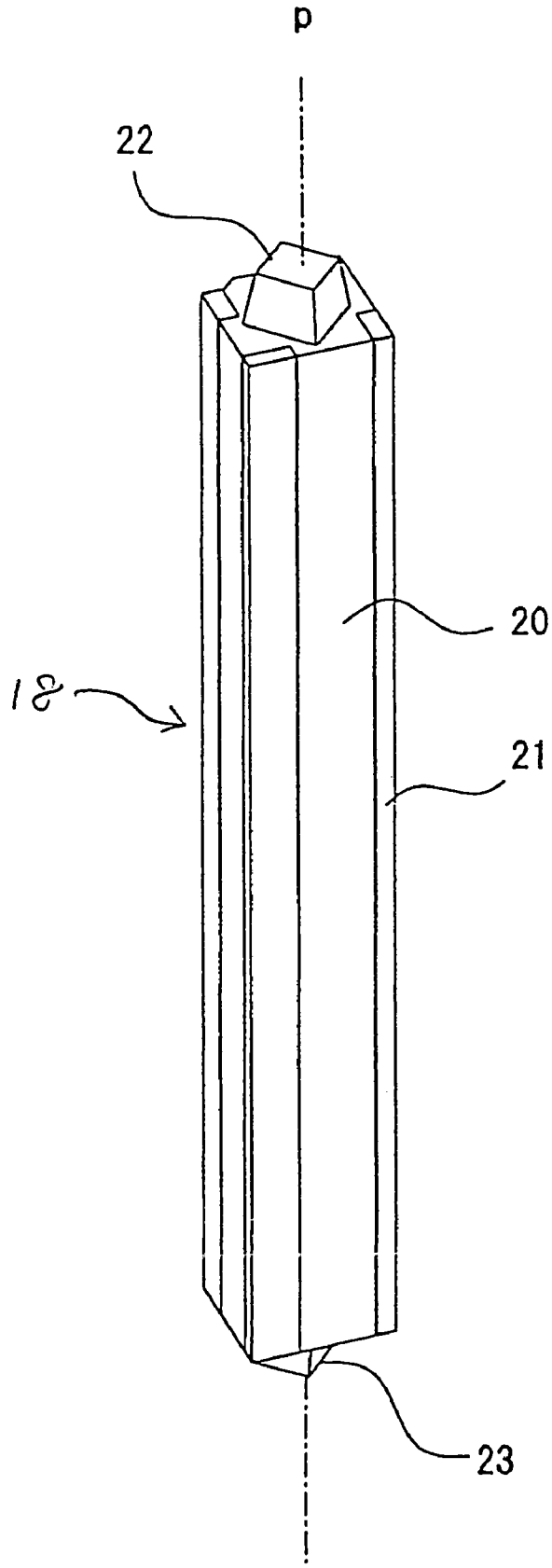
FIG. 6 is a perspective view of a blade used in the milling cylinder in FIG. 5.

The blades 18 that mill the raw grain each comprise a columnar main body 20, cutting tools 21, an upper mounting part 22, and a lower mounting part 23, as shown in FIG. 6. The columnar main body 20 has columnar shape with a square cross section; the upper mounting part 22, which has a square cross section, protrudes from the top of the columnar main body 20; the lower mounting part 23, which also has a square cross section, protrudes from the bottom of the columnar main body 20. The central axis p of the columnar body 20 passes through the center of the upper mounting part 22 and the center of the lower mounting part 23.

Figure 7:
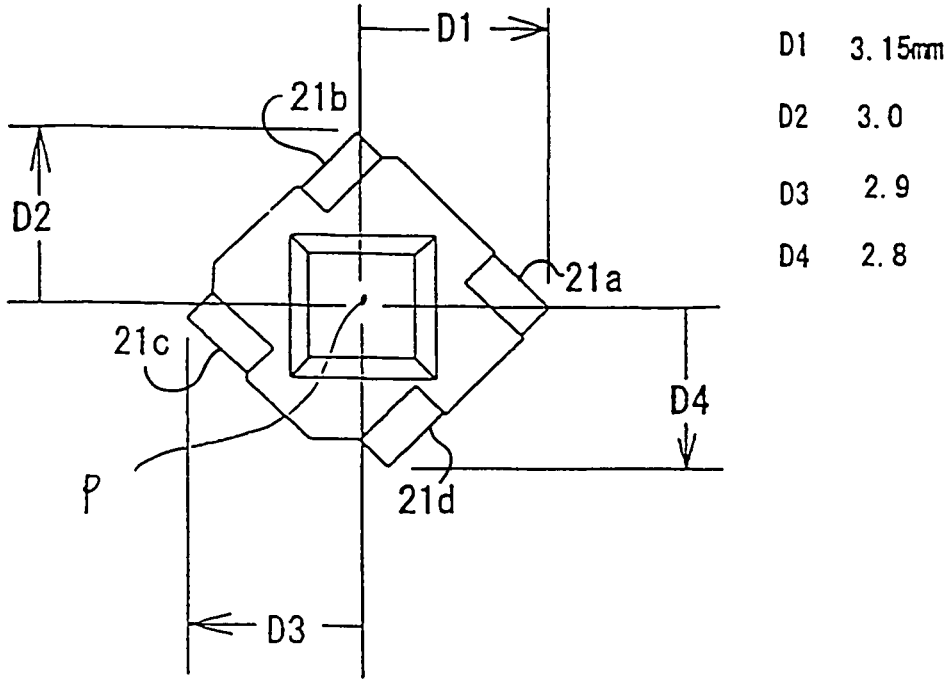
FIG. 7 is a plan view of the blade in FIG. 6.
Figure 8:
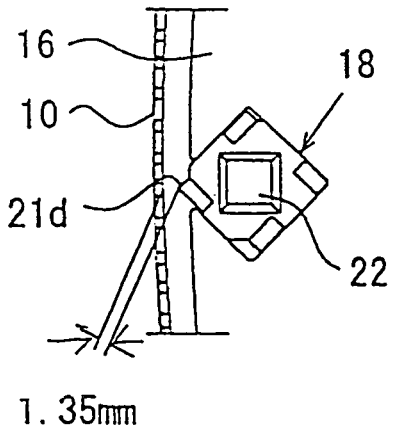
FIG. 8 is a plan view in which the blade in FIG. 6 is disposed to provide a large milling clearance.
Figure 9:
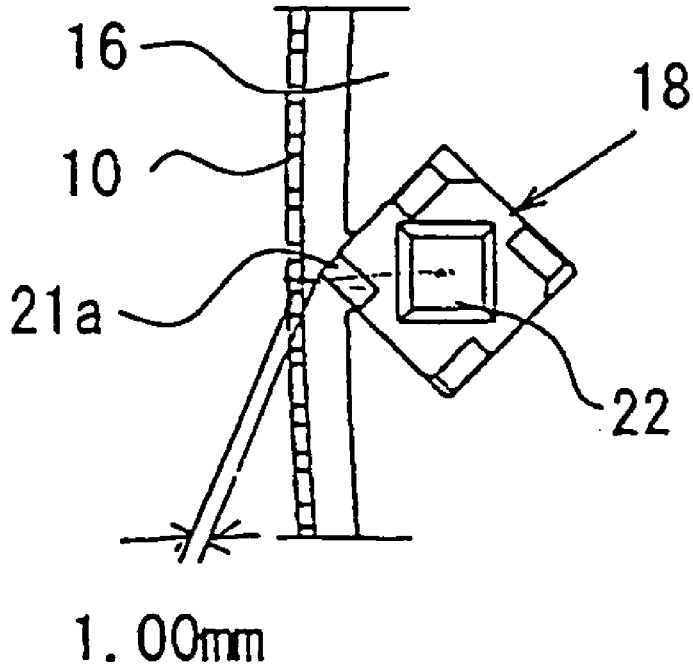
FIG. 9 is a plan view in which the blade in FIG. 6 is disposed to provide a small milling clearance.

A cutting tool 21 is disposed along each of the four ridges of the cross-sectionally square columnar main body 20. In FIG. 7, the four cutting tools 21 are identified by reference numerals 21*a*, 21*b*, 21*c*, 21*d*. Each cutting tool 21 is made separately of a cutting tool steel alloy and is bonded to the columnar main body 20.

D1 to D4 in FIG. 7 are distances from the central axis p of the columnar main body 20 of the blade 18 to the tips of the cutting tools 21*a* to 21*d*, respectively. These distances differ from one another: D1=3.15 mm, D2=3.0 mm, D3=2.9 mm, D4=2.8 mm, for example, as illustrated in FIG. 7.

As shown in FIG. 5, a plurality of attaching notches 24 are formed at equal intervals along the outer edge of the upper ring 16 of the milling cylinder 9; each attaching notch is shaped so that the columnar main body 20 of the blade 18 can fit externally into the notch. A plurality of mounting holes 25, which accept the lower mounting parts 23 of the blades 18, are also formed along the outer edge of the lower ring 17 at positions corresponding to the attaching notches 24 in the upper ring 16.

A supporting ring 28 similar in shape to the upper ring 16 and lower ring 17 and having the same central axis as these rings 16 and 17 is disposed at the midpoint between them. A plurality of attaching notches 29 are formed along the outer edge of the supporting ring 28 at the positions corresponding to the attaching notches 24 in the upper ring 16; each attaching notch is shaped so that the columnar main body 20 of the blade 18 can fit externally into the notch.

The upper ring 16, lower ring 17, and supporting ring 28, which are thus spaced vertically with a common central axis, are mutually secured by vertically passing a plurality of connecting bolts 30 through the upper ring 16, lower ring 17, and supporting ring 28, as shown in FIG. 3.

The lower mounting part 23 of a blade 18 is mated into a mounting hole 25 formed in the lower ring 17. Then, the blade 18 is externally fitted into the attaching notch 29 formed in the supporting ring 28 and the attaching notch 24 formed in the upper ring 16 by moving the blade 18 in the radial direction toward the center while keeping the blade 18 facing the upper ring 16 and lower ring 17.

When all of the blades 18 have been fitted into the mounting hole 25 and the attaching notches 29 and 24, a fixing ring 26 is placed on the upper ring 16 from above. The fixing ring 26 comprises a ring-shaped plate having almost the same shape as the upper ring 16; as shown in FIG. 5, the fixing ring has a plurality of mounting holes 27, into which the upper mounting parts 22 of the blades 18 fit, at positions corresponding to the attaching notches 24 in the upper ring 16. When the fixing ring 26 is placed on the upper ring 16, therefore, the upper mounting parts 22 of the blades 18 can fit into the mounting holes 27 in the fixing ring 26.

As described above, with the upper mounting parts 22 of the blades 18 fit into the mounting holes 27 in the fixing ring 26 and the lower mounting parts 23 fit into the mounting holes 25 in the lower ring 17, the blades 18 is integrally secured to the upper ring 16, lower ring 17 and supporting ring 28. When the columnar main body 20 of the blade 18 is lodged in the attaching notch 24 in the upper ring 16 and the attaching notch 29 in the lower ring 17, the columnar main body 20 is restrained from rotating around its central axis p, keeping a predetermined direction.

If the fixing ring 26 is removed, the upper mounting part 22 of the blade 18 is unlocked. By moving the blade 18 upward or outward from the upper ring 16, lower ring 17 and supporting ring 28, therefore, the blade 18 can be removed easily from the mounting hole 25 and the attaching notches 29 and 24. The removed blade 18 can also be attached to the upper ring 16, lower ring 17, and supporting ring 28 again with the blade rotated clockwise or counterclockwise through 90 or 180 degrees around the central axis p of the columnar main body 20.

In FIG. 4, reference numeral 32 indicates a guide fin secured between the upper ring 16 and lower ring 17 in correspondence with each blade 18.

Before the blade 18 is attached to the upper ring 16, lower ring 17 and supporting ring 28, which of the cutting tools 21 attached to the four ridges of the blade 18 is to face the screen 10 must be determined. For the blade 18 shown in FIG. 6, the cutting tool 21 that is to face to the screen 10 (or the cutting tool 21 to actually execute milling) changes each time the blade 18 is rotated 90 degrees around the central axis p of the columnar body 20. Since distances D1 to D4 from the central axis p of the columnar body 20 to the cutting tools 21*a* to 21*d* are different from each other, as shown in FIG. 7, the distance between the cutting tool and screen 10 (milling clearance d1) can be changed by selecting any cutting tool to face the screen 10 from among the four cutting tools 21*a* to 21*d*.

As described above, the milling cylinder 9 is formed by fitting the blades 18 to the upper ring 16, lower ring 17 and supporting ring 28, and further placing the fixing ring 26 on the upper ring 16. Then, the milling cylinder 9 is secured on the rotational disk 12 by passing a plurality of bolts 31 through the lower ring 17 and screwing the bolts 31 into the rotational disk 12, as shown in FIG. 3.

If the motor 5 is driven in order to rotate the milling cylinder 9 at high speed and grain is supplied from the supply pipe 7, the grain drops onto the rotational disk 12 and is impelled to the outer edge by centrifugal force. Then, the grain is fed from the clearance between each two adjacent guide fins 32 to the clearance between the screen 10 and the outer circumference of the milling cylinder 9 and milled by the blades 18 between the milling cylinder 9 and screen 10. Milling is performed repeatedly between the screen 10 and the blades 18 as they rotate at high speed. Grain that passes through the screen meshes having a width of about 0.25 to 0.4 mm becomes milled product. This milled product is discharged from the outlet path 19 to the outside. This discharge of the milled product is performed by the guide fins 32 described above, using the air blown by the guide fins 32.

If the clearance (milling clearance d1) between the screen 10 and the blades 18 facing the screen 10 has to be adjusted because, for example, a different type of grain is milled or the granularity of the product is changed, the milling cylinder 9 is removed from the milling section 3 and the fixing ring 26 is removed from the milling cylinder 9. Then, the blades 18 are removed from the upper ring 16, lower ring 17 and supporting ring 28. The cutting tool 21 to face the screen 10 is selected by rotating the columnar body 20 clockwise or counterclockwise through 90 or 180 degrees around its central axis p. Finally, the blades 18 are attached to the upper ring 16, lower ring 17 and supporting ring 28 again.

Each of the plurality of blades 18 can be directed with respect to the milling cylinder 9 in a manner such that the clearance (or milling distance d1) between the blade 18 and screen 10 is identical for all of the blades. Alternatively, one group of blades 18 may be given an identical milling clearance, d1, while another group may be given another identical milling clearance other than d1. Either method can be selected according to the milling conditions of the grain to be milled.

As mentioned above, the cutting tools 21 (21*a* to 21*d*) of the blade 18 shown in FIG. 7 are positioned at different distances from the central axis p of the columnar body. However, the cutting tools can also be positioned at the same distance (D1=D2=D3=D4). In this case, when one cutting tool 21*a* is worn out, the blade 18 can be rotated through 90 degrees around its central axis p to use another cutting tool 21*b* for milling. In this case, the distance d1 between the new cutting tool used for milling and the screen 10 remains the same as before, enabling a single blade 18 to be used for a long time under the same milling conditions.

Many forms of slits and many sizes are available for the screen 10, to meet various milling purposes.

The invention claimed:

1. An impact crushing apparatus having an inlet opening for supplying raw material to be milled, a milling cylinder disposed below the inlet opening and having a plurality of blades equally spaced on the outer edge of the milling cylinder, a screen cylinder fixed outward of the outer edge of the milling cylinder, an outlet path disposed outward of the screen cylinder for ejecting milled material, and a driving section for rotating the milling cylinder, wherein:

the milling cylinder has an upper ring and a lower ring with a common central axis, the upper ring and the lower ring being separated by a predetermined spacing;

each of the plurality of blades includes a columnar main body with a polygonal cross section and cutting tools attached along a plurality of ridges of the columnar main body; and one of a plurality of mounting directions of the blade relative to the upper ring and the lower ring is selected by rotating the blade through a predetermined angle around the central axis of the columnar main body of the blade and by mounting the top of the blade to the upper ring and also mounting the bottom to the lower ring.

2. The apparatus of claim 1, wherein the distance between the central axis of the columnar main body and the edge of the cutting tool attached along one ridge of the columnar main body differs from the distance between the central axis of the columnar main axis and the edge of the cutting tool attached along another ridge of said columnar main body.

3. The apparatus of claim 1, wherein the columnar main body of said blade has a substantially square cross section, the blades being mounted to the upper ring and the lower ring in such a way that any one of four directions can be obtained by rotating the blade around the central axis of the columnar main body.

4. The apparatus of claim 1, wherein:

a lower mounting part protrudes from the bottom of the columnar main body;

a plurality of notches are formed along the outer edge of the upper ring of the milling cylinder, the columnar main body of said blade being capable of externally fitting into any one of the plurality of notches; and a plurality of mounting holes are formed in the lower ring at positions corresponding to the positions of the notches in the upper ring, the lower mounting part being capable of fitting into any one of the mounting holes.

5. The apparatus of claim 1, wherein:

an upper mounting part protrudes from the top of the columnar main body;

the upper mounting part protrudes upward from the upper ring when the lower mounting part of the columnar main body of the blade fits into the mounting hole in the lower ring and the columnar main body also fits into the notch in the upper ring: and a fixing ring in which a plurality of mounting holes are formed along the circumference is placed on the upper ring, the upper mounting part fitting into any one of the mounting holes in the fixing ring.

* * * * *